US009458682B2

(12) United States Patent
McCulloch et al.

(10) Patent No.: US 9,458,682 B2
(45) Date of Patent: Oct. 4, 2016

(54) COILED TUBING INJECTOR WITH LIMITED SLIP CHAINS

(71) Applicant: National Oilwell Varco, L.P., Houston, TX (US)

(72) Inventors: David W. McCulloch, Arlington, TX (US); Timothy S. Steffenhagen, Fort Worth, TX (US); William B. White, Bedford, TX (US); William G. Stewart, Fort Worth, TX (US)

(73) Assignee: National Oilwell Varco, L.P., Houston, TX (US)

( * ) Notice: Subject to any disclaimer, the term of this patent is extended or adjusted under 35 U.S.C. 154(b) by 0 days.

(21) Appl. No.: 14/852,492

(22) Filed: Sep. 11, 2015

(65) Prior Publication Data

US 2016/0002987 A1 Jan. 7, 2016

Related U.S. Application Data

(62) Division of application No. 14/014,327, filed on Aug. 29, 2013, now Pat. No. 9,151,122, which is a division of application No. 12/890,323, filed on Sep. 24, 2010, now Pat. No. 8,544,536.

(51) Int. Cl.

| | |
|---|---|
| ***E21B 19/08*** | (2006.01) |
| ***E21B 19/22*** | (2006.01) |
| ***E21B 17/20*** | (2006.01) |

(52) U.S. Cl.

CPC ..... *E21B 19/08* (2013.01); *E21B 17/20* (2013.01); *E21B 19/22* (2013.01)

(58) Field of Classification Search

CPC ..... E21B 19/22

See application file for complete search history.

(56) References Cited

U.S. PATENT DOCUMENTS

| | | | |
|---|---|---|---|
| 2,282,597 | A | 5/1942 | Archer |
| 2,567,009 | A | 9/1951 | Calhoun et al. |
| 2,896,777 | A | 7/1959 | Hallam |
| 3,056,535 | A | 10/1962 | Baugh et al. |
| 3,182,877 | A | 5/1965 | Slator et al. |
| 3,216,639 | A | 11/1965 | Andre |
| 3,285,485 | A | 11/1966 | Slator |
| 3,373,818 | A | 3/1968 | Rike et al. |
| 3,401,749 | A | 9/1968 | Daniel |
| 3,559,905 | A | 2/1971 | Palynchuk |
| 3,618,840 | A | 11/1971 | Courret |

(Continued)

FOREIGN PATENT DOCUMENTS

| | | | |
|---|---|---|---|
| CA | 953644 | A | 8/1974 |
| CA | 1056808 | A | 6/1979 |

(Continued)

OTHER PUBLICATIONS

First Office Action and Search Report and English translation received in Chinese Patent Application No. 2011800562291, dated Oct. 10, 2014, 20 pages.

(Continued)

*Primary Examiner* — William P Neuder

(74) *Attorney, Agent, or Firm* — Derek V. Forinash; Porter Hedges LLP

(57) ABSTRACT

A coiled tubing injector comprises a drive system for independently driving a plurality of chains independently but otherwise retarding relative motion between the driven chains when a chain begins to slip uncontrollably.

12 Claims, 6 Drawing Sheets

(56) References Cited

U.S. PATENT DOCUMENTS

| | | | | |
|---|---|---|---|---|
| 3,638,288 | A | 2/1972 | Pryor | |
| 3,667,554 | A | 6/1972 | Smitherman | |
| 3,690,136 | A | 9/1972 | Slator et al. | |
| 3,724,567 | A | 4/1973 | Smitherman | |
| 3,778,094 | A | 12/1973 | Grolet et al. | |
| 3,822,559 | A | 7/1974 | Matthews et al. | |
| 3,824,875 | A | 7/1974 | Willert et al. | |
| 3,827,487 | A | 8/1974 | Jackson et al. | |
| 3,866,882 | A | 2/1975 | Willm et al. | |
| 3,920,076 | A | 11/1975 | Laky | |
| 4,013,205 | A | 3/1977 | Fabre-Curtat et al. | |
| 4,172,391 | A | 10/1979 | Dressel | |
| 4,585,061 | A | 4/1986 | Lyons, Jr. et al. | |
| 4,655,291 | A | 4/1987 | Cox | |
| 4,899,620 | A | 2/1990 | Schiffer | |
| 5,102,378 | A | 4/1992 | Gobert | |
| 5,133,405 | A | 7/1992 | Elliston | |
| 5,188,174 | A | 2/1993 | Anderson, Jr. | |
| 5,234,053 | A * | 8/1993 | Connell | E21B 19/22 166/250.01 |
| 5,309,990 | A | 5/1994 | Lance | |
| 5,381,861 | A | 1/1995 | Crafton et al. | |
| 5,533,659 | A | 7/1996 | Meyer | |
| 5,553,668 | A | 9/1996 | Council et al. | |
| 5,566,764 | A | 10/1996 | Elliston | |
| 5,775,417 | A | 7/1998 | Council | |
| 5,850,874 | A | 12/1998 | Burge et al. | |
| 5,890,534 | A | 4/1999 | Burge et al. | |
| 5,918,671 | A | 7/1999 | Bridges et al. | |
| 5,937,943 | A | 8/1999 | Butler | |
| 5,975,203 | A | 11/1999 | Payne et al. | |
| 6,059,029 | A | 5/2000 | Goode | |
| 6,135,202 | A | 10/2000 | Koshak | |
| 6,173,769 | B1 | 1/2001 | Goode | |
| 6,216,780 | B1 | 4/2001 | Goode et al. | |
| 6,332,501 | B1 | 12/2001 | Gipson | |
| 6,347,664 | B1 | 2/2002 | Perio, Jr. | |
| 6,516,891 | B1 | 2/2003 | Dallas | |
| 6,880,629 | B2 | 4/2005 | Schroeder | |
| 6,910,530 | B2 | 6/2005 | Austbo et al. | |
| 7,150,330 | B2 | 12/2006 | Domann | |
| 7,383,879 | B2 | 6/2008 | Kulhanek et al. | |
| 7,431,097 | B2 | 10/2008 | Weightmann | |
| 2003/0034162 | A1 | 2/2003 | Kulhanek | |
| 2004/0182574 | A1 * | 9/2004 | Adnan | G05B 15/02 166/250.01 |
| 2005/0205267 | A1 | 9/2005 | Dallas | |
| 2006/0076148 | A1 | 4/2006 | Kulhanek et al. | |
| 2007/0246261 | A1 | 10/2007 | Lowe et al. | |
| 2009/0091278 | A1 | 4/2009 | Montois et al. | |
| 2009/0250205 | A1 | 10/2009 | Koopmans et al. | |
| 2012/0073833 | A1 * | 3/2012 | McCulloch | E21B 19/08 166/384 |

FOREIGN PATENT DOCUMENTS

| | | | |
|---|---|---|---|
| CA | 1096850 | A | 3/1981 |
| CN | 201567978 | U | 9/2010 |
| CN | 201581835 | U | 9/2010 |
| EP | 0507280 | A | 10/1992 |
| EP | 0524648 | A | 1/1993 |
| GB | 2029478 | A | 3/1980 |
| GB | 2247260 | A | 2/1992 |
| WO | 0008296 | A | 2/2000 |
| WO | 2005003505 | A | 1/2005 |

OTHER PUBLICATIONS

International Search Report and Written Opinion received in Patent Cooperation Treaty Application No. PCT/US2011/049684, Nov. 29, 2011, 11 pages.

International Search Report and Written Opinion received in Patent Cooperation Treaty Application No. PCT/US2012/053397, Mar. 19, 2013, 11 pages.

* cited by examiner

COILED TUBING INJECTOR WITH LIMITED SLIP CHAINS

RELATED APPLICATION

This application is a divisional of U.S. patent application Ser. No. 14/014,327 filed Aug. 29, 2013, which is a divisional of U.S. patent application Ser. No. 12/890,323 filed Sep. 24, 2010, the entirety of both applications are hereby incorporated by reference.

TECHNICAL FIELD OF THE INVENTION

The invention pertains generally to injectors for running tubing and pipe into and out of well bores.

BACKGROUND

"Coiled tubing injectors" are machines for running pipe into and out of well bores. Typically, the pipe is continuous but it can also be jointed pipe. Continuous pipe is generally referred to as coiled tubing since it is coiled onto a large reel when it is not in a well bore. The terms "tubing" and "pipe" are, when not modified by "continuous," "coiled" or "jointed," synonymous and encompass both continuous pipe, or coiled tubing, and jointed pipe. "Coiled tubing injector" refers to machines used for running any of these types of pipes or tubing. The name of the machine derives from the fact that it is was originally used for coiled tubing and that, in preexisting well bores, the pipe must be literally forced or "injected" into the well through a sliding seal to overcome the pressure of fluid within the well, until the weight of the pipe in the well exceeds the force produced by the pressure acting against the cross-sectional area of the pipe. However, once the weight of the pipe overcomes the pressure, it must be supported by the injector. The process is reversed as the pipe is removed from the well.

Coiled tubing is faster to run into and out of a well bore than conventional jointed or straight pipe and has traditionally been used primarily for circulating fluids into the well and other work over operations, rather than drilling. However, coiled tubing has been increasingly used to drill well bores. For drilling, a turbine motor is suspended at the end of the tubing and is driven by mud or drilling fluid pumped down the tubing. Coiled tubing has also been used as permanent tubing in production wells. These new uses of coiled tubing have been made possible by larger diameters and stronger pipe.

When in use, a coiled tubing injector is normally mounted to an elevated platform above a wellhead or is mounted directly on top of a wellhead. A typical coiled tubing injector is comprised of two continuous chains, though more than two can be used. The chains are mounted on sprockets to form elongated loops that counter rotate. A drive system applies torque to the sprockets to cause them to rotate. In most injectors, chains are arranged in opposing pairs, with the pipe being held between the chains. Grippers carried by each chain come together on opposite sides of the tubing and are pressed against the tubing. The grippers, when they are in position to engage the tubing, ride or roll along a skate, which is typically formed of a long, straight and rigid beam. The injector thereby continuously grips a length of the tubing as it is being moved in and out of the well bore. Each skate forces grippers against the tubing with a force or pressure that is referred to as a normal force, as it is being applied normal to the surface of the pipe. The amount of traction between the grippers and the tubing is determined, at least in part, by the amount of this force. In order to control the amount of the normal force, skates for opposing chains are typically pulled toward each other by hydraulic pistons or a similar mechanism to force the gripper elements against the tubing. However, the skates could also be pushed. Examples of coiled tubing injectors include those shown and described in U.S. Pat. Nos. 5,309,990, 6,059,029, and 6,173,769, all of which are incorporated herein by reference.

A drive system for a coiled tubing injector includes at least one motor. For larger injectors, intended to carry heavy loads, each chain will typically be driven by a separate motor. The motors are typically hydraulic, but electric motors can also be used. Each motor is coupled either directly to a drive sprocket on which a chain is mounted, or through a transmission to one or more drive sockets. Low speed, high torque motors are often the preferred choice for injectors that will be carrying heavy loads, for example long pipe strings or large diameter pipe. However, high speed, low torque motors coupled to drive sprockets through reduction gearing are also used.

If only one motor is used, it can be used to drive one of the two chains, with the other chain not being driven, or it can be coupled to both chains through a gear or gear train. If separate motors are used to drive each chain, each is coupled to a chain independently of the other. In such arrangements, the chains can be synchronized using a timing gear to cause precise rotational coordination of the two drive sprockets. Such systems are designed so that each drive sprocket turns at exactly the same rotational speed, thereby causing the injector chains to move at the same speed relative to one another, in terms of number of chain links per time.

However, if each chain link is not precisely the same length, and they are not likely to be, then the chains are moving at different speeds relative to each other in terms of distance per time, and one of the chains must then slip with respect to the pipe. The traction of the grippers on the pipe is proportional to the normal force that the skate system applies to the grippers in contact with the pipe. If the normal force is so high as to prevent the slipping, the longer chain will tend to bunch at the slack side entering the grip zone, which is the area between the chains. Chain bunching can cause damage to the chain, the grippers and/or the pipe. To avoid bunching, the normal force must be carefully controlled to allow the chains to slip with respect to the tubing as the difference in length accumulates. However, not enough force can result in out-of-control slipping of the tubing into the well bore, creating substantial damage. Thus, when choosing a normal force, an operator of the injector is forced to carefully balance beneficial slipping that controls the change in length accumulation with the risk of an out-of-control slip of the tubing through the injector.

Because injector chains are inherently timed or synchronized by being in contact with the opposing sides of the same tubing, the choice is often made to forgo the benefits of precisely controlled synchronization. In an unsynchronized injector, each chain is driven independently, which permits each chain to rotate at different speeds. With such a system, minor differences between the length of the chains are not an issue, since the drives can rotate at different speeds to accommodate the differences in chain length without causing slipping. This produces a smooth and efficient drive system.

SUMMARY

However, with independently driven chains there is a risk that one of the chains will begin to slip on the tubing before the other. Once a chain begins to slip on the tubing, the type of friction changes from static to dynamic and the traction of the slipping chain is greatly diminished. In hydraulic drive systems, for example, each motor is connected to a hydraulic power source in parallel, meaning that a single source of hydraulic fluid under pressure supplies each of the motors in parallel. When a chain slips, the motor driving that chain has less demand for torque, and therefore more hydraulic fluid flows to it, because the flow will take the path of lesser resistance. This results in the motor turning faster. Thus, once a chain starts slipping, it tends to keep slipping. This can cause damage to the tubing. The following description is of coiled tubing injectors in which each of a plurality of chains is independently driven, meaning that the chains do not turn synchronously or at the same speed, but in which the motion of a chain is slowed when it otherwise begins to speed up due to uncontrolled slippage of grippers.

DETAILED DESCRIPTION OF EXEMPLARY EMBODIMENTS

Figure 1:
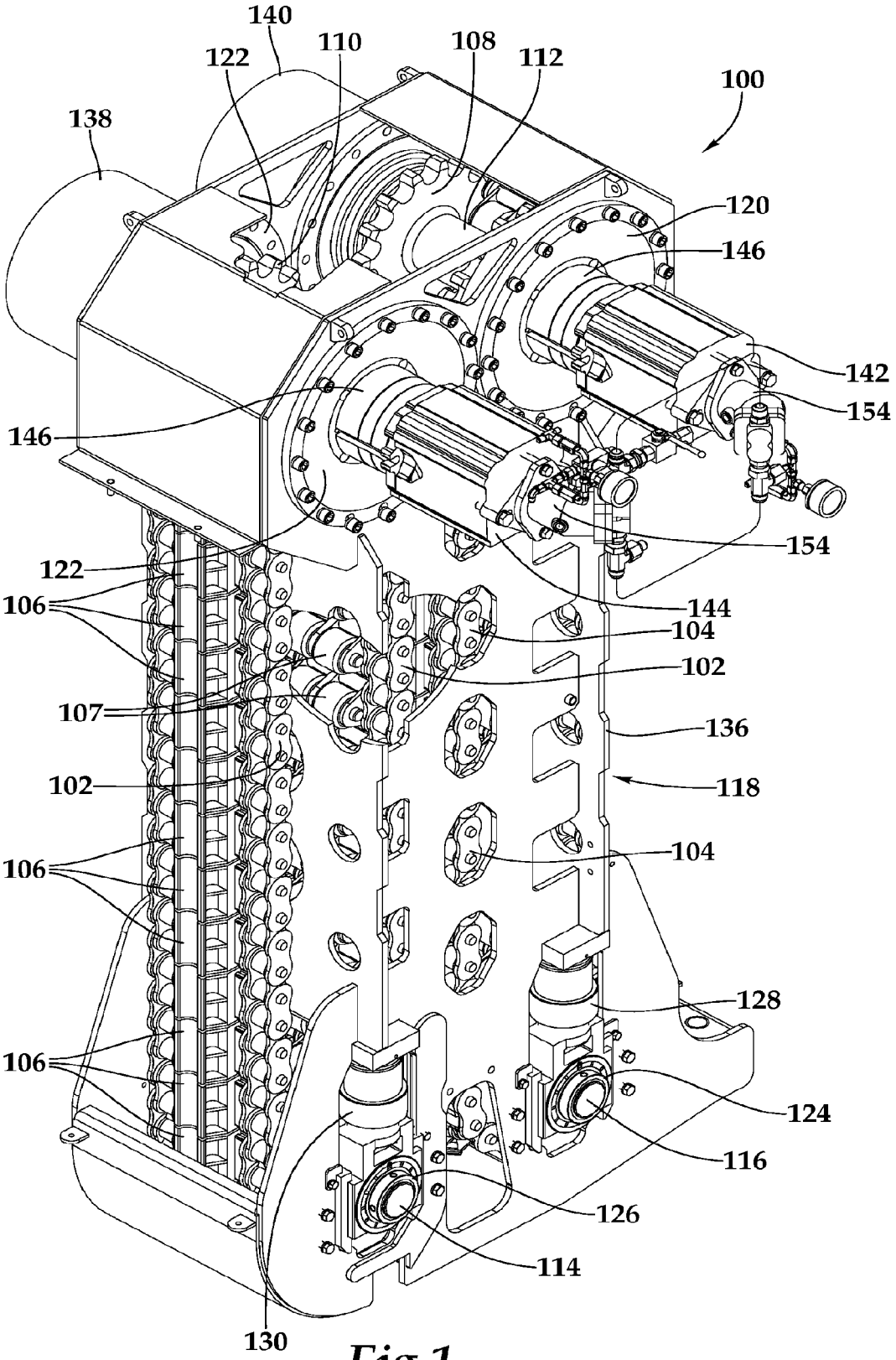
FIG. 1 is a perspective view of a representative coiled tubing injector having a drive system with two motors independently driving each of two chains and additional timing motors for transferring power from one chain to the other.

In the following description, like numbers refer to like elements.

FIGS. 1-5 each illustrate an example of a coiled tubing injector 100. Each figure illustrates the same representative injector, but with different examples of drive systems. Injector 100 is intended to be representative generally of injectors that can be used for both continuous and jointed pipe or tubing, and that have at least two counter-rotating, continuous loop chains, at least two of which are driven so as to apply a force to tubing passing between the chains that is parallel to the axis of the tubing. Please note parts of the injector have been removed or cut away in order to illustrate some of the features that would otherwise be obscured.

Representative injector 100 has two chains 102 and 104 that are arranged so that they oppose each other. Each of the chains carry a plurality of grippers 106 that are shaped to conform to the outer diameter of tubing to be gripped. The grippers from the chains come together as the tubing passes through the injector and substantially encircle the tubing to prevent it from being deformed and to ensure that the gripping force applied by skates (not visible in the figures) along which rollers 107 disposed on the back side of the grippers roll when they are adjacent the tubing is distributed around the outer surface of the tubing. In the illustrated example, which has only two chains, chains 102 and 104 revolve generally within a common plane. (Note that chains 102 and 104 are cut away at the top of the injector in order to reveal the sprockets on which they are mounted.) Injectors can have more than two chains. For example, a second pair of chains can be arranged in an opposing fashion within a plane that is ninety degrees to the other plane, so that four gripping elements come together to engage the tubing as it passes through the injector.

Chains of an injector are mounted or supported on at least two sprockets, one at the top and the other at the bottom of the injector. The upper and lower sprockets are, in practice, typically comprised of two spaced-apart sprockets that rotate around a common axis. In the illustrated examples, only one of each pair of sprockets 108 and 110 is visible. The upper sprockets in this example are driven. These drive sprockets are connected to a drive axle or shaft that is rotated by a drive system. Only one shaft, referenced by number 112, for upper drive sprocket pair 108, is visible in the figures. The lower sprockets, which are not visible in the figures, except for the end of shafts 114 and 116 to which they are connected, are not driven in this representative injector 100. They are, therefore, referred to as idler sprockets. The lower sprockets could, however, be driven, either in place of or in addition to, the upper sprockets. Furthermore, additional sprockets could be added to the injector for the purpose of driving each of the chains.

The sprockets are supported by a frame generally indicated by the reference number 118. The shafts for the upper sprockets are held on opposite ends by bearings. These bearings are located within two bearing housings 120 for shaft 112 and two bearing housings 122 for the other shaft that is not visible. The shafts for the lower sprockets are also held on opposite ends by bearings, which are mounted within moveable carriers that slide within slots with the frame. Only two front side bearings 124 and 126 can be seen in the figures. Allowing the shafts of the lower sprockets to move up and down permits the chains to be placed under constant tension by hydraulic cylinders 128 and 130.

Although not visible, coiled tubing injector 100 includes two skates, one for each chain, for forcing the grippers toward each other as they enter the area between the two drive chains through which the tubing passes. Examples of such skates are shown in U.S. Pat. Nos. 5,309,990 and 5,918,671. A plurality of hydraulic cylinders (which have been removed from the figures in order to better show other components) pull together the skates and maintain uniform gripping pressure against coiled tubing (not shown) along the length of the skates.

The frame 118, in this particular example of an injector, takes the form of a box, which is formed from two, parallel plates, of which plate 132 is visible in the drawing, and two parallel side plates 134 and 136. The frame supports sprockets, chains, skates and other elements of the injector, including a drive system and brakes 138 and 140. Each brake is coupled to a separate one of the drive shafts, on which the upper sprockets are mounted. In a hydraulically powered system, the brakes are typically automatically activated in the event of a loss of hydraulic pressure.

The two driven chains of representative injector 100 are driven in each of the FIGS. 1 to 5 by a different drive system. However, in each case the two driven chains are driven independently, meaning without synchronization, which allows the chains to rotate at different speeds if necessary in order to accommodate differences in lengths of the two chains without having to slip. In FIGS. 1 to 4, the drive system is comprised of two motors 142 and 144. In this example, there is thus at least one motor for each drive sprocket. More motors could be added for driving each driven chain, for example by connecting them to the same shaft, or by connecting them to a separate sprocket on which the chain is mounted. In drive systems of the type illustrated in FIGS. 1 to 4, if more than two chains are driven, at least one additional motor is added for each additional chain. The output of each motor is coupled to the shaft of the drive sprocket for the chain being driven by the motor, the motor thereby also being coupled with the chain. Each motor is coupled either directly or indirectly, such as through an arrangement of gears, an example of which is a planetary gear box 146. In the drive system of FIG. 5, only one motor, 148, is used to drive two drive sprockets, one for each chain. This motor is connected to an input to a differential gear box 150 having multiple outputs, one for each drive sprocket. The outputs are coupled in this example to the drive sprockets through gearboxes 152.

In each of the examples of FIGS. 1 to 5, the illustrated motor is hydraulic. However, electric motors can be substituted for the hydraulic motors.

Figure 2:
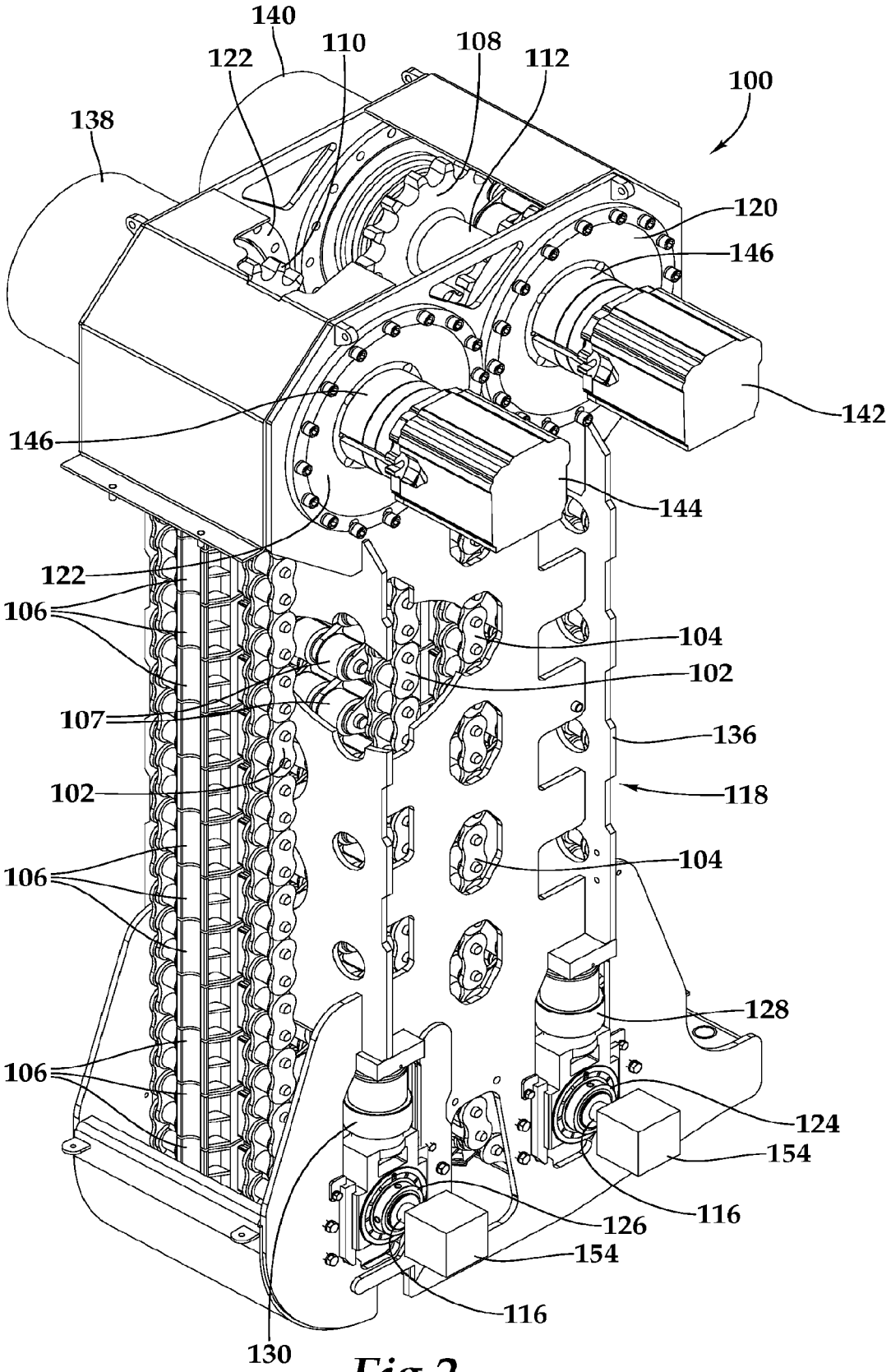
FIG. 2 is a perspective view of a representative coiled tubing injector with an alternate embodiment for the drive system of FIG. 1.

Please refer now only to FIGS. 1 and 2. In the examples of the injector illustrated in FIGS. 1 and 2, an auxiliary or timing motor 154 is coupled with each driven chain so that it rotates with the chains. So long as the timing motors are driven at the same speed, no power is transferred between the motors. However, the auxiliary motors are coupled so that, when one auxiliary motor starts turning sufficiently faster than the other, power is transferred from that motor to the other motor, essentially applying a force on the faster turning chain that slows it down and causes the other chain to speed up. In one embodiment, the timing or auxiliary motors are hydraulic and connected to the same hydraulic circuit (not shown in FIGS. 1 and 3) in series such that, as long as they are turning at precisely the same speed, no drive torque is developed between the motors and the drive motors. A deliberate, but small, leakage path between the auxiliary motors allows for slight differences in rotational speeds between the chains without causing pressure and therefore torque to be applied to chain that might be turning faster. However, as the difference in the speeds of the timing motors increases, such as when one chain begins to slip with respect to the other, the timing motors begin to resist rotating at the different speeds. That resistance is in the form of pressure building in the timing motor circuit, and the resulting torque is transferred to the chains to cause them to run close to the same speed, preventing the single chain slip from continuing. In the example of FIG. 1, the timing motors are connected by a spline connection to the drive shaft of drive motors 142 and 144. However, as shown in FIG. 2, the timing motors could, instead, be coupled to the shafts of idler sprockets—for example shafts 124 and 126 in the figure—on which the driven chains are mounted.

Figure 3:
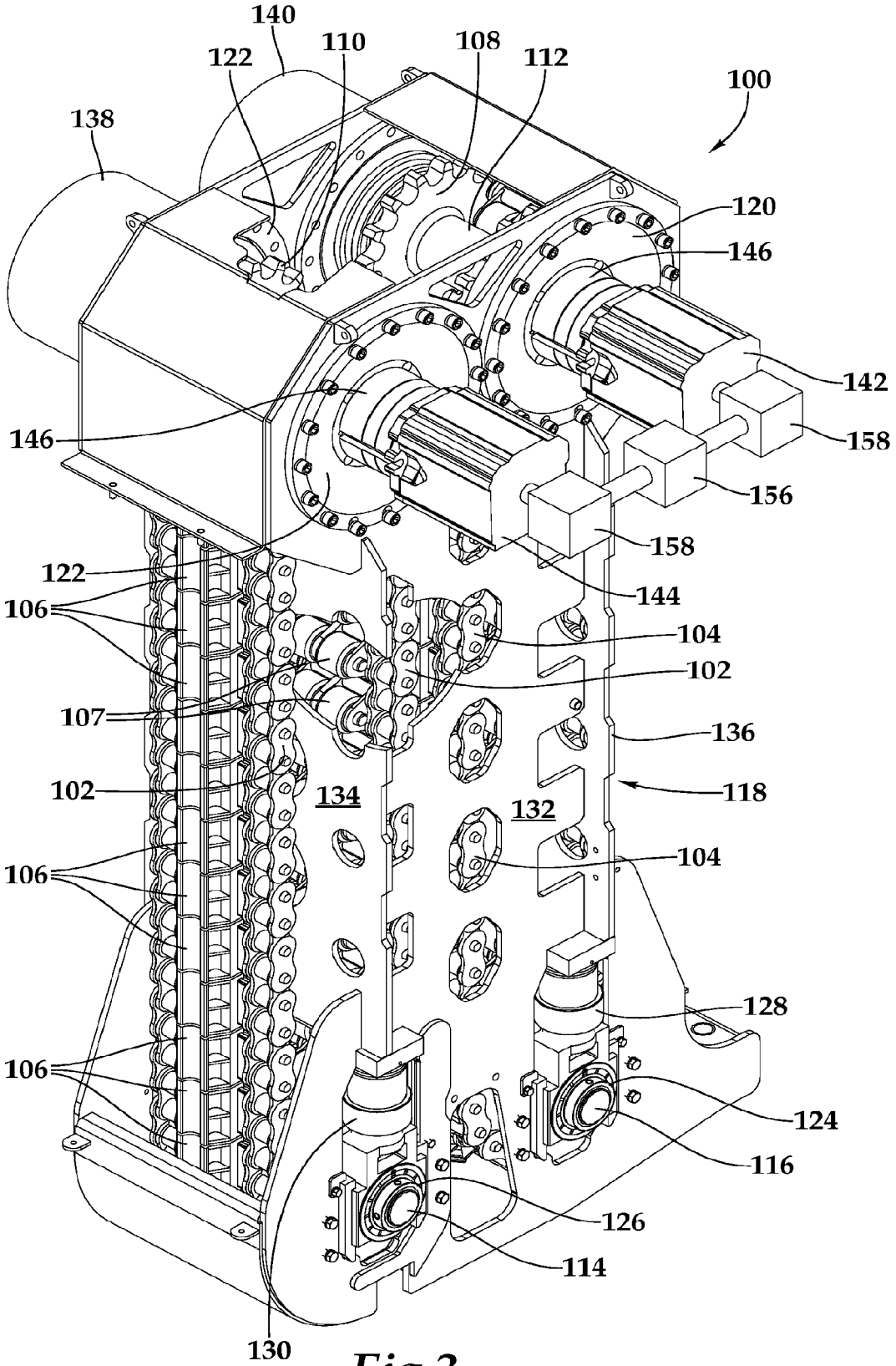
FIG. 3 is a perspective view of a representative coiled tubing injector with an alternate embodiment for the drive system of FIG. 1.
Figure 4:
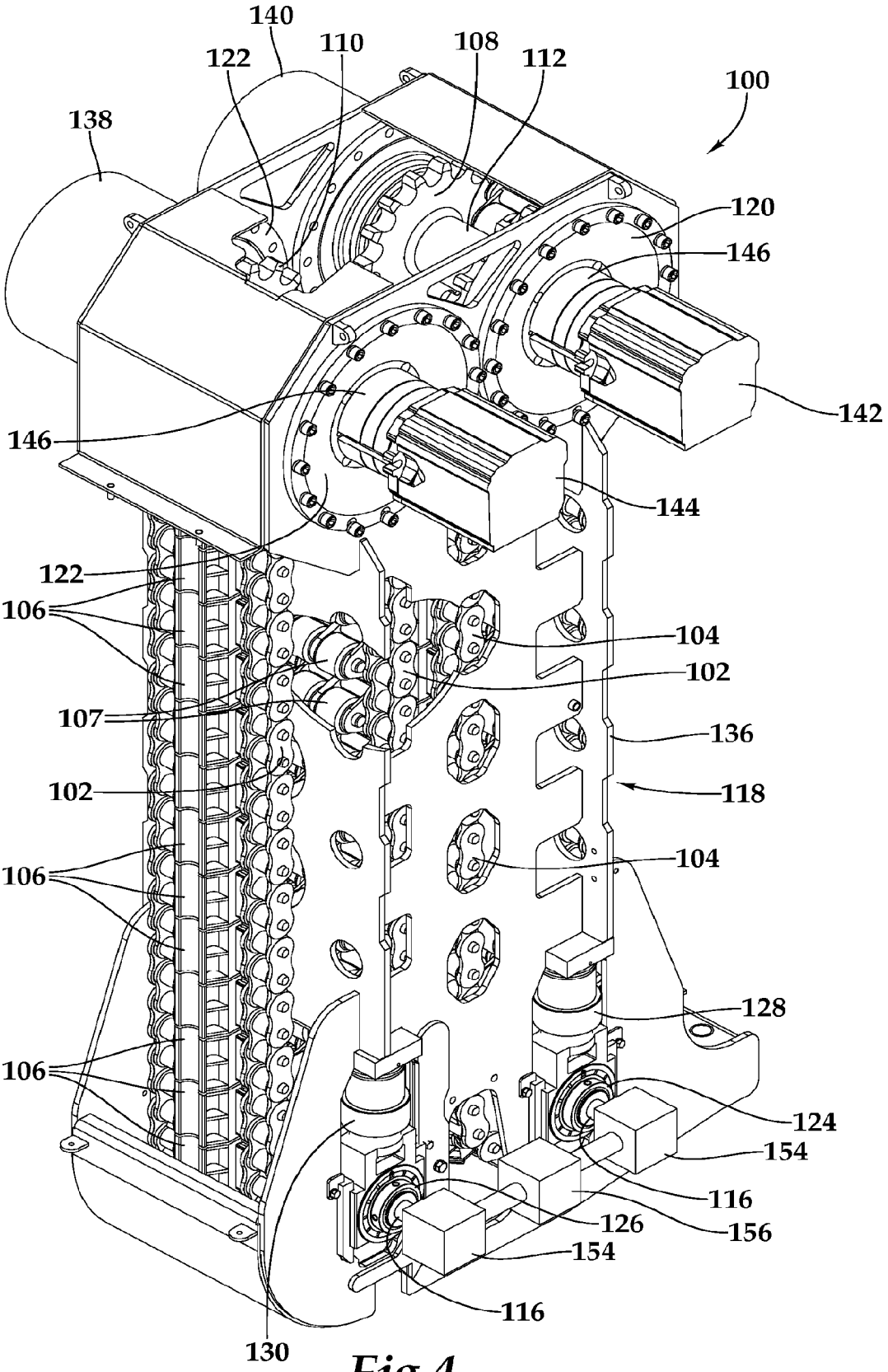
FIG. 4 is a perspective view of a representative coiled tubing injector with an alternate embodiment for the drive system of FIG. 1.

FIGS. 3 and 4 illustrate an alternative embodiment to the drive system of FIGS. 1 and 2. Like the drive systems of FIGS. 1 and 2, the drive systems of the injector pictured in each of FIGS. 3 and 4 include two, independent drive motors 142 and 144, separately coupled with the drive shafts of the drive sprockets for the two chains. However, the chains 102 and 104 are coupled to each other through a limited slip differential 156 (clutch type or other type). In the example of FIG. 3, the limited slip differential is connected to the drive shafts of the two drive motors. In the example of FIG. 3, it is connected between the shafts of 124 and 126 of the idler sprockets. No torque is transmitted by the limited slip differential unless the speed differential between the chains (or between the rotational speed of the shafts of the motors) is sufficient to cause the limited slip differential to engage, in which case torque from the faster turning chain is transmitted to the slower turning chain, thereby causing the faster turning chain to slow.

Figure 5:
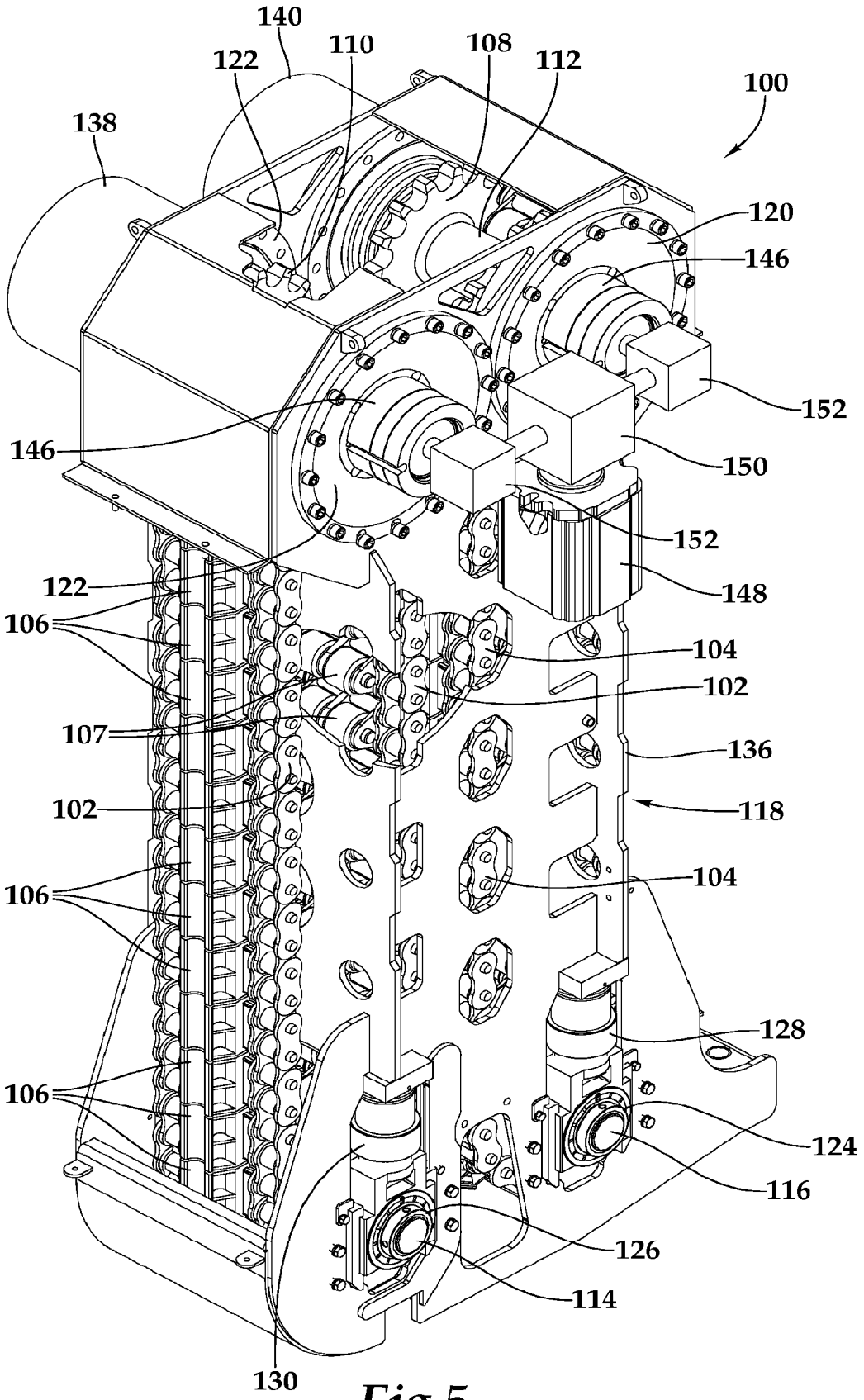
FIG. 5 is a perspective view of a representative coiled tubing injector with an alternate embodiment for the drive system of FIG. 1.

In the example of FIG. 5, the single drive motor 148 independently drives each chain through differential 150. Differential 150 is limited slip to prevent all of the torque of the motor from going just to one chain. Small variations in rotational speed between the drive sprockets of the respective chains are tolerated. However, when one chain starts turning sufficiently faster than the other, a limited slip differential ensures that both resume turning at nearly the same speed.

Figure 6:
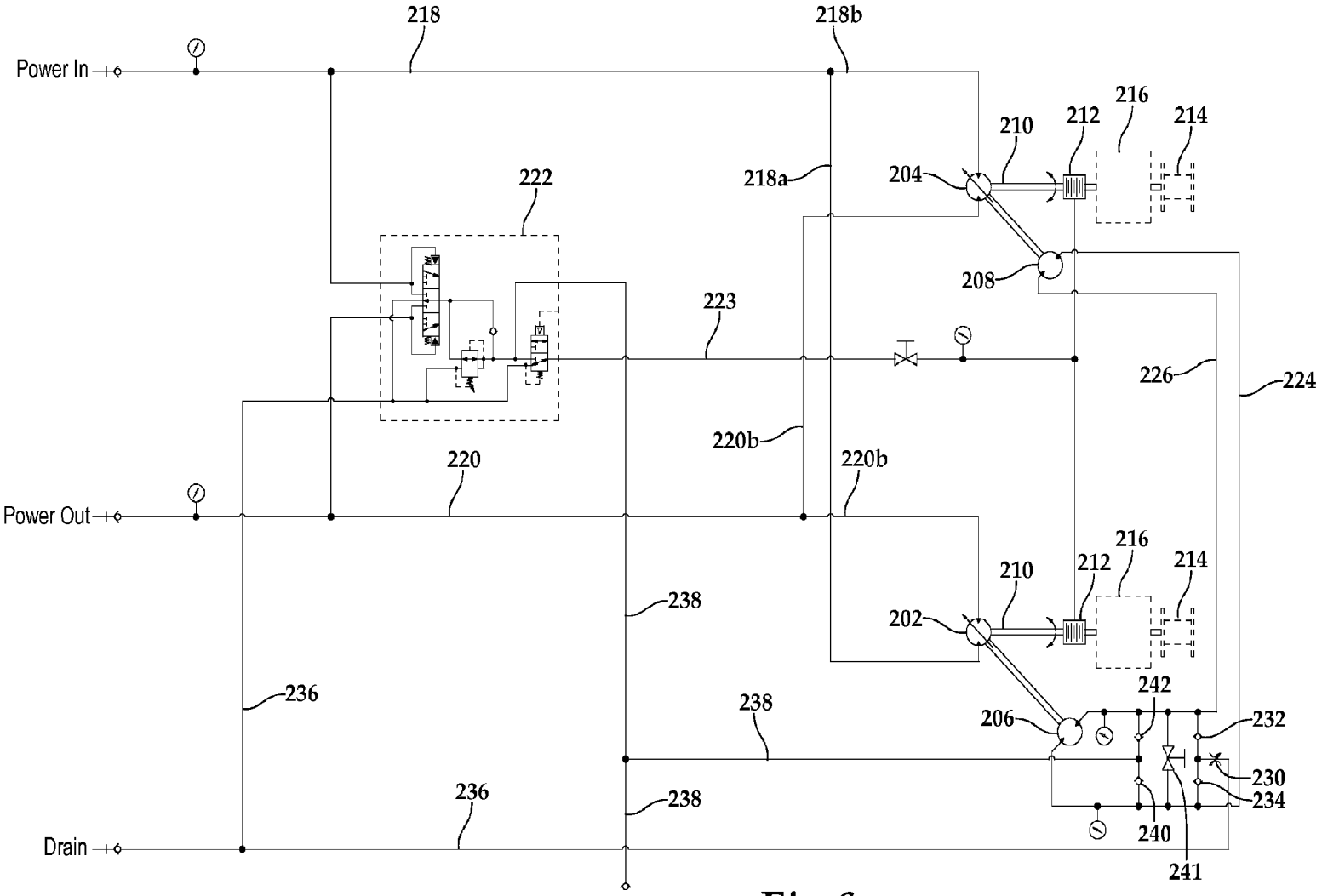
FIG. 6 is a schematic illustration of a hydraulic system for powering a drive system such as shown in FIG. 1 that is implemented hydraulically.

FIG. 6 is a simplified schematic illustration of an exemplary embodiment of a simplified circuit that can be used with the injectors such as those show in FIGS. 1 and 2. This schematic assumes that the timing motor 154 and drive motors 142 and 144 are hydraulic. In the schematic, hydraulic drive motors are referenced by numbers 202 and 204. The timing motors 206 and 208 are mechanically coupled to the drive motors 202 and 204. The coupling is illustrated as being direct, as shown in FIG. 1. However, it could be indirect, such as through the drive chain, as shown in FIG. 2. Each drive motor has an output shaft 210 that is coupled to a brake 212 and to a drive sprocket 214 through an optional gear box 216, which is in this example a planetary gear box. Each drive sprocket drives rotation of a different chain. Pressurized hydraulic fluid from, for example, a power pack (not shown) is supplied through supply line 218 to both drive motors 202 (through branch 218*a*) and 204 (through branch 218*b*). The hydraulic motors are connected to the return line 220 through lines 220*a* and 220*b*, respectively. The drive motors are thus connected to the hydraulic power supply in parallel. In the event the difference between the pressure in supply line 218 and return line 220 falls below a certain set point, indicating a possible interruption or failure of the hydraulic power supply, the brakes 212 are automatically actuated when the pressure supplied by manifold assembly 222 on line 223 discharges through drain line 236.

The timing motors 206 and 208 are connected in series in a closed circuit formed by lines 224 and 226. A valve 241 is placed in a short circuit line and opened to allow bleeding of relatively small amounts of hydraulic fluid when a pressure differential builds between the two sides of the circuit. This is caused by one of the motors turning slightly faster than the other motor such as when one chain is to some extent longer than the other. However, this flow is small enough to allow the buildup of pressure in the timing circuit when there is a sufficient difference in the speed of the drive motors such as when one chains is slipping. Hydraulic fluid drained from one side of the circuit through one-way valves 232 and 234 and flow restriction valve 230 is replaced in the circuit through a servo hydraulic supply line 238, which is connected through one-way valves 240 and 242 to lines 224 and 226, respectively. This supply and drain flow serves to charge the circuit with fluid and provide flow through it for flushing out contamination and to cool the circuit. Valve 241 can be opened to equalize pressure between the two sides of the circuit.

In an alternative embodiment, electric motors are substituted for only the hydraulic drive motors, with changing the hydraulic auxiliary motors being used. The hydraulic circuit for the hydraulic motors could remain the same. In another alternative embodiment, the electric motors are used for timing motors. The drive motors could be either hydraulic or electric. In such an embodiment the motor connected to the faster driving chain would act as a generator, and the electric power is transferred to the other motor. A control circuit limits transfer until a certain voltage differential between the motors is reached so that torque is not applied to either motor (either in a way that speeds it up or slows it down) when there are only small speed differences. Alternatively, the relative speeds of the chains could be sensed and, when a predetermined threshold difference is exceeded, a controller in response applies an opposing torque with the timing motor to the faster chain, such as by switching in a load, which could be, for example, the other timing motor or some other resistance or reactance (depending on the type of electric motor) in series with the timing motor. The amount of the load is, for example, related to the speed differential based on a predetermined function. Additional torque could also, optionally, be applied to the slower chain by supplying power to the other timing motor.

In another alternative embodiment to the drive systems indicated by FIGS. 1-5, drive motors 142 and 144 are, if they are hydraulic motors, connected with a hydraulic power source in series, rather than in parallel. Such a connection results in each motor turning at the same speed if they are the same displacement, since they are receiving exactly the same flow in a series arrangement. In yet another alternative, the speed of each motor on an independent drive is monitored, and a control system directs an appropriate flow of hydraulic power or electrical power, depending on whether the drive motors are hydraulic or electrical, to each drive motor in order to speed control and thus prevent one from running so much faster than the other as to indicate slippage of one of the chains. Different rotational speeds would be permitted. However, when a drive motor driving a chain begins to run at a speed differential indicating slippage, the controller, in response, causes the faster motor to slow down. Optionally, the slower turning motor is sped up. In an hydraulic drive, the controller would limit the flow, thus reducing the flow rate of the hydraulic fluid. For example, if the motors are on separate circuits, the flow is restricted without redirecting it to the other drive motor. Alternatively, if the motors are connected in parallel on the same circuit, a portion of the flow is redirected to the other drive motor, in effect selectively creating shunt between the parallel branches of the circuit. This could also be accomplished in a hydraulic drive by dynamically varying the displacement of one or both of the drive motors, or in an electric drive by varying the power input to one or both electric drive motors.

The foregoing description is of an exemplary and preferred embodiments employing at least in part certain teachings of the invention. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated structures or the disclosed embodiments.

The invention claimed is:

1. A coiled tubing injector, comprising:

a plurality of chains, each of which is comprised of a continuous loop and carries a plurality of grippers, the plurality of chains being arranged for gripping tubing placed between the plurality of chains; the plurality of chains comprising at least two driven chains; and a drive system for turning the plurality of chains comprising at least two drive motors, each of the at least two drive motors being coupled, respectively, to one of the at least two driven chains, the drive system further comprising a controller for directing flow of power to each of the least two drive motors in order to permit different rotational speeds of the least two driven chains that is less than a difference indicating that one of the at least two driven chains is slipping, and to reduce the difference in rotational speeds when the difference in rotational speeds indicates that one of the at least two driven chains is slipping.

2. The coiled tubing injector of claim 1, wherein the at least two drive motors are variable displacement hydraulic motors that are coupled in parallel in a hydraulic power circuit; and wherein the controller dynamically changes displacement of at least one of the at least two drive motors to reduce the difference in rotational speeds between the at least two driven chains when the difference in rotational speeds indicates that one of the at least two driven chains is slipping.

3. The coiled tubing injector of claim 1, wherein the at least two drive motors are hydraulic motors that are coupled in parallel to separate branches of a hydraulic power circuit; and wherein the controller creates a shunt between the branches of the hydraulic circuit in order to reduce the difference in rotational speeds between the at least two driven chains when the difference in rotational speeds indicates that one of the at least two driven chains is slipping.

4. The coiled tubing injector of claim 1, wherein the at least two drive motors are hydraulic motors that are coupled in parallel to separate branches of a hydraulic power circuit; and wherein the controller restricts flow of hydraulic power to one of the at least two drive motors in order to reduce the difference in rotational speeds between the at least two driven chains when the difference in rotational speeds indicates that one of the at least two driven chains is slipping.

5. The coiled tubing injector of claim 1, wherein the at least two drive motors are electric motors, and wherein the controller varies power input to at least one of the at least two drive motors in order to reduce the difference in rotational speeds between the at least two driven chains when the difference in rotational speeds indicates that one of the at least two driven chains is slipping.

6. A coiled tubing injector, comprising:

a plurality of chains, each of which is comprised of a continuous loop and carries a plurality of grippers, the plurality of chains being arranged for gripping tubing placed between the plurality of chains; the plurality of chains comprising at least two driven chains; and a drive system for turning the plurality of chains comprising, at least two drive motors coupled, respectively, to each of the at least two driven chains, at least two electric timing motors respectively coupled with the at least two drive motors, the at least two timing motors electrically coupled; and a controller, wherein the controller limits transfer of electrical power between the two timing electric motors until a predetermined voltage differential between the at least two electric timing motors is reached so that torque is not applied to any of the at least two electric timing motors to allow for speed differences between the at least two driven chains associated with different lengths of the at least two driven chains.

7. A coiled tubing injector, comprising:

a plurality of chains, each of which is comprised of a continuous loop and carries a plurality of grippers, the plurality of chains being arranged for gripping tubing placed between the plurality of chains; the plurality of chains comprising at least two driven chains; and a drive system for turning the plurality of chains comprising, at least two drive motors, each of which is coupled to a different one of the at least two driven chains;

at least two electric timing motors, each of which coupled with a different one of the at least two drive motors; and a control circuit for applying torque, in response to relative speeds of the at least two driven chains exceeding a predetermined threshold difference, to the electric timing motor coupled with the faster turning of the at least two driven chains.

8. The coiled tubing injector of claim 7, wherein the controller switches a load in series with the electric timing motor coupled with the faster turning of the at least two driven chains to apply torque to that electrical timing motor.

9. A coiled tubing injector, comprising:

two driven chains for gripping tubing placed between the two driven chains;

two variable displacement hydraulic motors, each of which coupled to a corresponding one of the two driven chains;

a controller dynamically changing displacement of at least one of the variable displacement hydraulic motors to permit a speed difference between the variable displacement hydraulic motors that is less than a difference indicating that one of the two driven chains is slipping, and to reduce the speed difference between the variable displacement hydraulic motors when the speed difference indicates that one of the two driven chains is slipping.

10. The coiled tubing injector of claim 9 wherein the two variable displacement hydraulic motors are connected in parallel to a hydraulic power source.

11. A method, comprising:

providing a coiled tubing injector including two driven chains for gripping tubing placed between the two driven chains, and two variable displacement hydraulic motors, each of which coupled to a corresponding one of the two driven chains;

monitoring speeds of each variable displacement hydraulic motor;

changing displacement of at least one of the variable displacement hydraulic motors to permit a speed difference between the variable displacement hydraulic motors that is less than a difference indicating that one of the two driven chains is slipping; and changing displacement of at least one of the variable displacement hydraulic motors to reduce the speed difference between the variable displacement hydraulic motors when the speed difference indicates that one of the two driven chains is slipping.

12. The method of claim 11 further comprising wherein the two variable displacement hydraulic motors are connected in parallel to a hydraulic power source.

* * * * *